United States Patent [19]

Norden

[11] 4,306,759

[45] Dec. 22, 1981

[54] INSULATION-CUTTING CONNECTORS AND METHOD OF MAKING CONNECTIONS

[76] Inventor: Alexander R. Norden, 350 Central Park West, New York, N.Y. 10025

[21] Appl. No.: 109,162

[22] Filed: Jan. 2, 1980

[51] Int. Cl.[3] ..... H01R 4/10

[52] U.S. Cl. ..... 339/99 R; 339/97 R

[58] Field of Search ..... 339/95 R–99 R

[56] References Cited

U.S. PATENT DOCUMENTS

| | | | |
|---|---|---|---|
| 3,234,498 | 2/1966 | Logan | 339/97 |
| 3,253,251 | 5/1966 | Norden | 339/198 |
| 3,521,221 | 7/1970 | Lenaerts et al. | 339/97 |
| 3,605,071 | 9/1971 | Sedlacek | 339/97 P |
| 3,609,642 | 9/1971 | Norden | 339/95 D |
| 3,634,605 | 1/1972 | Dola | 339/98 X |
| 3,636,500 | 1/1972 | Sedlacek | 339/97 R |
| 3,718,888 | 2/1973 | Pasternak | 339/98 |
| 3,824,527 | 7/1974 | Evans | 339/97 R |
| 3,895,852 | 7/1975 | Wasserlein | 339/99 R |
| 3,910,672 | 10/1975 | Frantz | 339/97 P |
| 4,012,102 | 3/1977 | Cherney et al. | 339/97 P |
| 4,116,522 | 9/1978 | Reynolds | 339/97 R |

*Primary Examiner*—Eugene F. Desmond

[57] ABSTRACT

The disclosed connectors include a paired-prong type of terminal which initially supports a plastic-insulated wire across the ends of the prongs at a gap. A driver initially forms incisions in the insulation at opposite sides of the wire. Further operation of the driver forces the wire into the gap, baring areas of the wire at the incisions and then making contact. The terminals are formed of metal strip, first making a slit along an end portion of the strip to form a pair of prongs and then coining a depression in opposed edges of the slit roughly halfway along the slit while confining the prongs against separation more than a prescribed gap distance.

27 Claims, 21 Drawing Figures

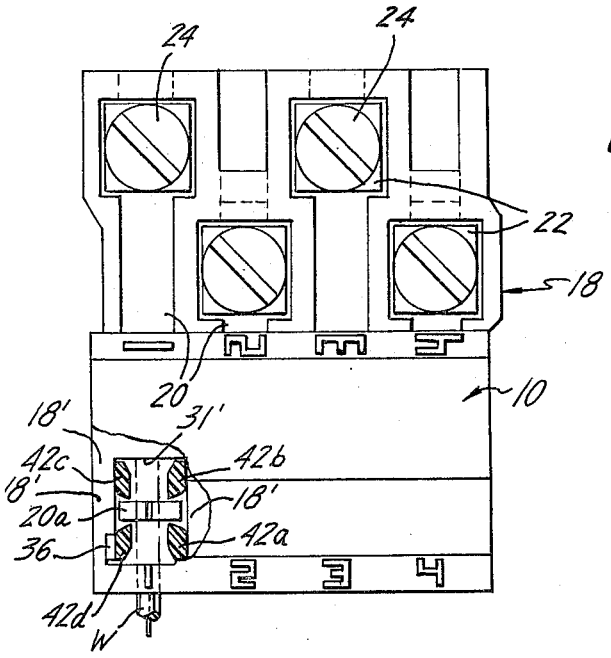
FIG. 3
FIG. 1
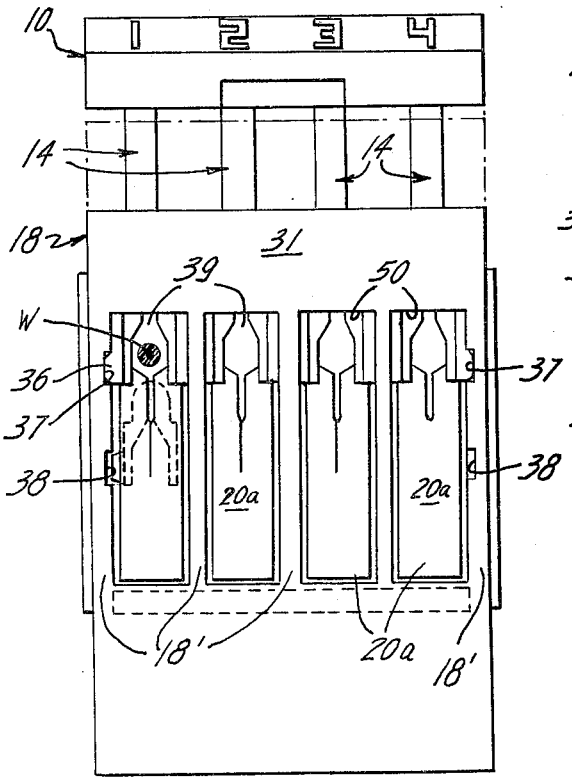
FIG. 2
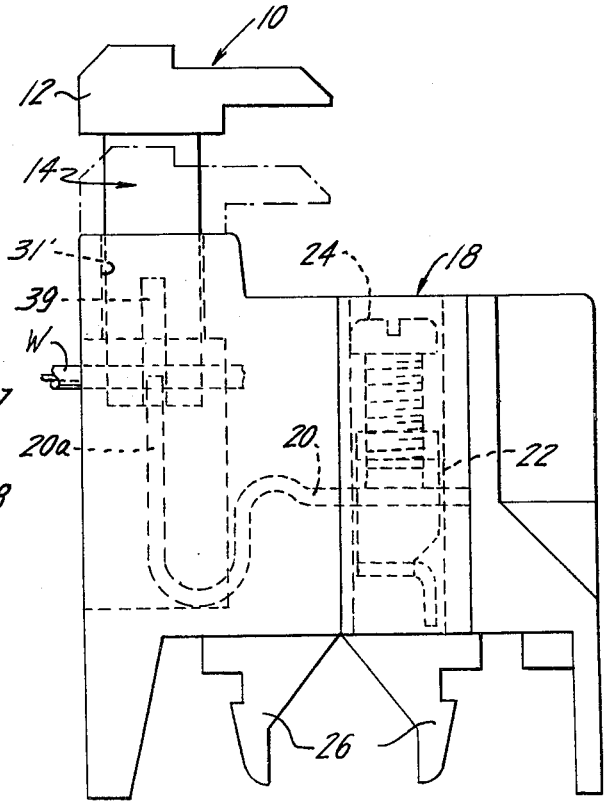

FIG. 4
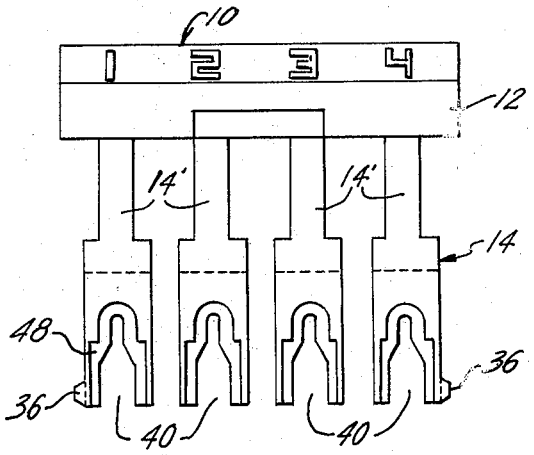
FIG. 5
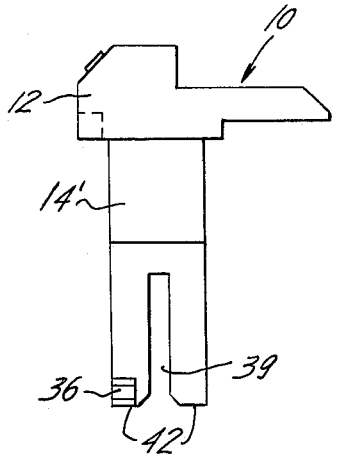
FIG. 6
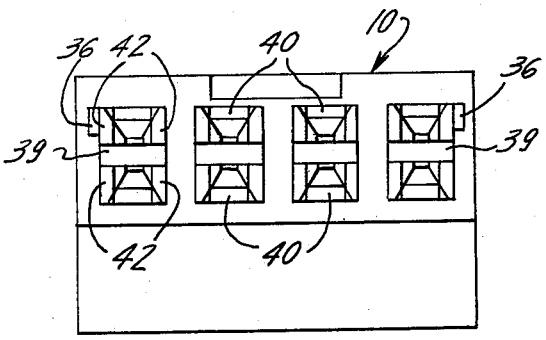
FIG. 7
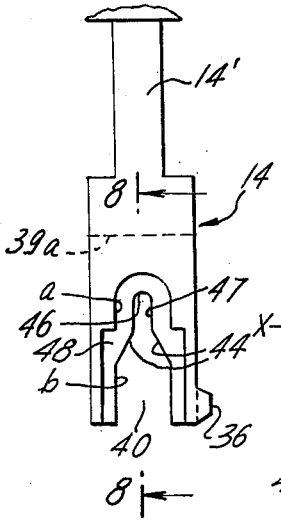
FIG. 8
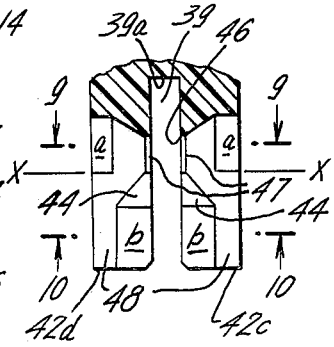
FIG. 9
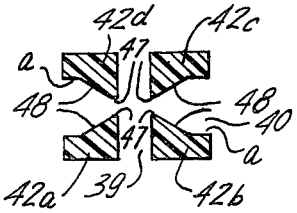
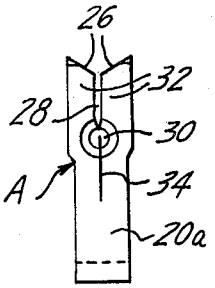
FIG. 13
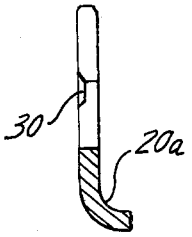
FIG. 12
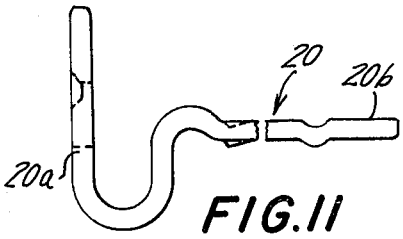
FIG. 11
FIG. 10
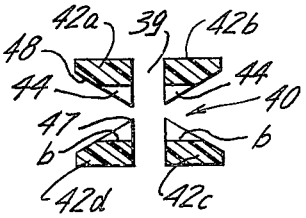

INSULATION-CUTTING CONNECTORS AND METHOD OF MAKING CONNECTIONS

The present invention relates to paired-prong terminals, to methods by which the terminals make connections to insulated wire, and to resilient paired-prong terminal members and their method of manufacture.

BACKGROUND OF THE INVENTION

It has long been known that insulated wire can be forced into the gap of a divided terminal without first stripping the insulation. In some cases the terminal edges at the gap are rigid while in others the terminal has stiff yet resilient prongs. The insulation is generally crushed by opposite edges of the terminal as the wire is forced into the gap, to bare areas of the wire for contact. In some instances, there are sharp corners on the terminal at the entrance to the gap. The sharp corners are intended to make short incisions in the insulation extending parallel to the length of the wire, thus facilitating further rupture of the insulation where the conductor of the insulated wire is to make contact with the terminal. Sharpness at those corners may rupture protective oxide-inhibiting plating on the metal conductor and, in the case of stranded conductor wire, it may shear some of the strands.

Special tools are sometimes used to forcibly assemble the wire to the terminal. In other cases, the terminal structure includes a removable cover which is formed to serve as a driver. In general, more-or-less brute force of the terminal acting against the wire driven against it is relied on to crush and part the area of insulation that must be removed in making wire-to-terminal contact. Where stranded wire is used, the crushing action often drives some insulation between the strands, making the prongs bear against insulation, creating unreliable connection. The construction often imposes critical parameters on the design and manufacture of the terminals. Thus, a terminal having a slot bounded by rigid sides or excessively stiff prongs may well be very effective in tearing through wire insulation, but it may fail to make dependable long-term contact with wire's conductors or it may slice conductor strands, depending on the wire size. In a rigid structure, a wire which is disturbed after insertion, as by handling, may loosen and provide intermittent contact. Excessively supple resilient prongs of a terminal may not be consistently effective in stripping insulation as intended.

A widely known form of insulation-rupturing wire terminal involves a strip of metal having an end portion divided lengthwise into a pair of prongs. That terminal characteristically includes three zones: (1) an end zone having a wire-receiving gap; (2) an intermediate zone where edges of the prongs are pre-biased against each other; and (3) an elongated slot with separated edges, terminating where the prongs join the rest of the terminal strip. The slot evidently was considered a manufacturing requirement, and because it adds length to the prongs, the prongs have been stiffly pre-biased toward each other to meet the basic insulation-crushing and wire-contacting functions.

It is known from my U.S. Pat. No. 3,609,642 issued Sept. 28, 1971, that certain materials, especially certain grades of polymeric materials, can be used to cut through polymeric insulation without risking incision into the copper conductor of the insulated wire. Evidently, that principle has not been put to use in wire-stripping connectors.

SUMMARY OF THE INVENTION

The disclosed connector includes terminals each comprising a pair of resilient prongs having opposed elongated contact edges separated by a gap, and a driver having paired edges for cutting wire insulation but not the metal conductor of the wire. Where the driver is part of the connector, it is normally formed of electrical insulation. Indeed, the driver can be a separate tool. The driver is particularly effective in making the present incisions in wire insulation without harming the copper or other relatively soft conductor, where it is made of "medium-hard" material, i.e. harder than wire insulating material, but softer than the conductor material. For vinyl-insulated copper-conductor wire, the driver may be of relatively soft metal such as aluminum or it may be of "medium-hard" insulation such as a suitably hard polymeric material. In the illustrative embodiment of the invention, the driver's cutting edges are in planes spaced apart a little more than the thickness of the prongs. The driver disposes a wire across the ends of the prongs. As the wire is driven laterally toward and along the prongs, initially pairs of incisions are formed in the wire insulation. The insulation between the pairs of incisions is ruptured to expose areas of the wire's conductor for contact and the locally exposed conductor is driven between the contact edges of the pair of prongs. More generally, areas of the wire are bared by the contact-making prongs at incisions first made by the driver.

The disclosed terminals are formed of a metal strip. An end portion of the strip is slit initially, forming a pair of prongs. While the prongs are constrained against moving apart by more than a prescribed gap, a depression is coined into the strip at opposed edges of the slit at a point partway along the slit. The resulting resilient prongs are separated by a wire-receiving gap that extends along some or all of the prong length. The entire length of the prongs contributes to their resilience. The terminals are heat-treated for relieving internal stresses so that no dependence is placed on pre-biasing the prongs toward each other.

The contribution of the driver and its cutting edges in preparing the insulation for final rupture by the pair of prongs of the terminal may reduce drastically the stresses imposed on the prongs, simplifying the design criteria heretofore involved in producting such terminals. In using stranded wire, a very critical balance was previously required, on one hand between prongs stiff enough to reliably force off all insulation, leaving none between the strands and the prongs, and on the other hand, prongs not yielding enough, and thus shearing some of the strands. With the novel terminals, once the geometry and material of the prongs are determined, since the wire insulation is pre-cut by the driver, there is nothing critical about both providing optimum contact of the terminal to the wire, and providing assurance that the terminal will serve adequately in its role of completing the removal of insulation from the contact areas as discussed above.

The nature of the invention in its various aspects, including further novel features and advantages, will be recognized and appreciated more fully from the following detailed description of an illustrative embodiment that is shown in the accompanying drawings.

BRIEF DESCRIPTION OF THE DRAWINGS

FIG. 1 is an end view of a novel electrical connector including a base and head;

FIG. 2 is a side view of the connector;

FIG. 3 is a top plan view of the connector;

FIG. 4 shows the head of FIGS. 1–3 including four drivers for four wires, the head being viewed as in the case of FIG. 1;

FIG. 5 is a side view of the head;

FIG. 6 is a bottom plan view of the head, FIGS. 1–6 all being shown enlarged;

FIG. 7 is a greatly enlarged fragmentary view of the driver at the right end of FIG. 4;

FIG. 8 is a fragmentary longitudinal cross-section of the driver as seen from the plane 8—8 in FIG. 7;

FIGS. 9 and 10 are cross-sections of the driver as seen from the planes 9—9 and 10—10, respectively, toward plane X—X in FIG. 8;

FIG. 11 is an enlarged lateral view of one of four terminals of the novel electrical connector;

FIG. 12 is a fragmentary cross-section of the terminal of FIG. 11 at a vertical medial plane;

FIG. 13 shows the terminal as viewed from the right in FIG. 11;

THE ILLUSTRATIVE EMBODIMENT

Figure 14:
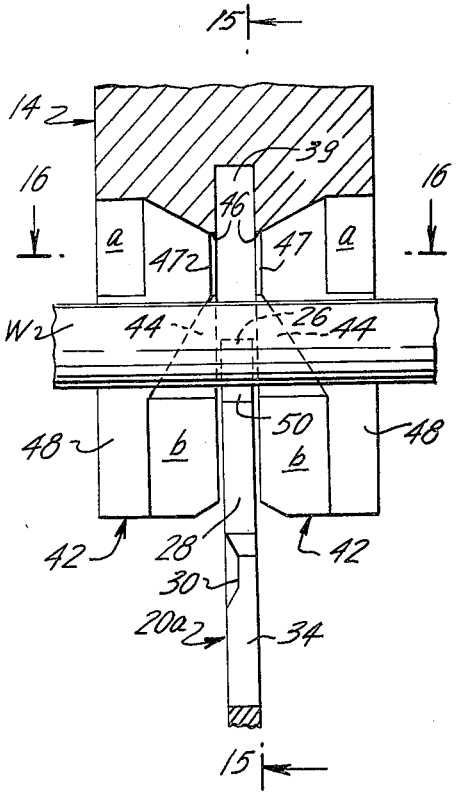
FIG. 14 is a greatly enlarged fragmentary cross-section of portions of the electrical connector, including a driver as seen in FIG. 8 and a terminal, plus a wire in its initial position, just before initial movement of the driver into engagement with the wire.

In FIGS. 1–3, head 10 includes a cover portion 12 and four drivers 14 of generally rectangular cross-section that slide loosely in like-shaped passages 31' in portion 31 of base member 18. Head 10 and base member 18 are of molded nylon in a practical example, such as heat-stabilized Nylon 6.

Four strips of metal 20, of tin-plated copper alloy in an example, constitute terminals that are appropriately fixed in position in base member 18. Strips 20 are of different lengths to extend into respective wire-clamping collars 22 at staggered positions (FIG. 3). Screws 24 are threaded in the top walls of collars 22. The ends of the screws bear against the top surfaces of their respective strips 20. A wire (not shown) inserted into a collar 22 (from the right in FIG. 2) below its strip 20 is drawn against strip 20 as the screw is tightened. Base member 18 is one of a series of like base members of electrical connectors having bottom formations 26 adapting them to lock onto a mounting rail (not shown). My U.S. Pat. No. 3,253,251, issued May 24, 1966, shows this rail, and the details of collar 22.

As seen in FIGS. 11–13, each terminal 20 includes an upstanding portion **20*a* that is formed to grip an inserted wire. Its opposite end 20*b* is received in a collar 22** that clamps a wire against the lower surface of the strip terminal.

The method of manufacture of portion **20*a* represents a departure from previous methods used for manufacturing wire-stripping terminals. In fabrication, the strip is subjected to a shearing operation that develops a medial slit along the strip, defining a pair of prongs. This lancing operation causes one of the prongs to curve out of its original plane. The slit strip is then flattened. At this point the lanced prong tends to curve divergently from the center line, because parent metal was stretched at the base of lance. The strip is then placed in a confining die section, the walls of which are spaced apart a distance slightly larger than the initial width of the strip up to point A (FIG. 13), and above point A the walls of the die section are spaced by a distance equal to the initial width of the strip plus the width of gap 28. A coining tool then forms depression 30, while the outer edges of prongs 32 are confined between the walls of the die. A shearing tool then cuts the end of the strip to form surfaces 26, which diverge at an angle of 30° in an example. Prongs 32 and their wire-engaging edges at gap 28 become parallel and spaced apart by a controlled uniform dimension less than the nominal diameter of the wire to be forced into the gap. Advantageously, the part is heat-treated to relieve stresses, largely or entirely eliminating any pre-tensioning of the prongs toward each other. By virtue of slit 34 below the coined depression 30, flexibility of the prongs is increased so that they can spread apart elastically and grip tightly but resiliently wires of a limited range of different diameters when forced into gap 28**.

Figure 15:
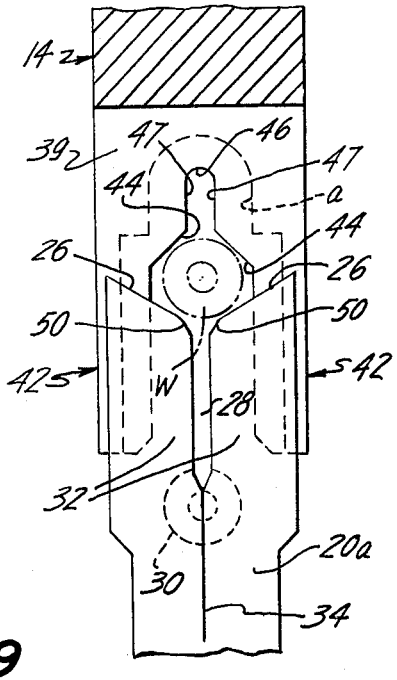
FIGS. 15 and 16 are fragmentary cross-sections of the structure in FIG. 14 viewed at the planes 15—15 and 16—16 in FIG. 14.

The drivers 14 of the head are shaped as shown in FIGS. 4 through 10. As noted above, drivers 14 slide loosely in portion 31 of base member 18. The outermost drivers 14 have outward projecting detents 36 (FIG. 4) that cooperate with complementary cavities 37 and 38 (FIG. 1) in base member 18 to hold head 10 alternatively in its elevated (solid-line) position and in its fully depressed (dotted-line) position. Driver 14 has a slot 39 that is only slightly wider (e.g. 0.055 inch) than the thickness of terminal 20 (e.g. 0.047 inch). Driver 14 also has a slot 40 (FIG. 4) which, with slot 39, divides the lower end portion of driver 14 into four legs 42 (FIG. 6), namely legs **42*a*, 42*b*, 42*c* and 42*d* (FIG. 9). The surfaces of slot 39 are parallel to the broad faces of strip portion 20*a*. Strip portion 20*a* is received in slot 39 when the head is depressed. The legs of driver 14 have recesses defined in part by surfaces a and b (FIGS. 8 and 14) which lie in planes parallel to the plane of those views. Each slot 40 has chamfers 48 that meet the faces of slot 39 at dull insulation-cutting edges 47 (e.g. 0.005 inch wide). (Even if these cutting edges were sharp, they would become deformed in the cutting operation and then they would behave as dull edges). Tiny triangular areas 44 diverge from their apices at cutting edges 47 and span the insulated wire. Edges 47 merge into shearing edge 46 over the wire. The included angle between the surfaces that form cutting and shearing edges 47 and 46 may vary widely in dependence on the hardness of the driver and the hardness of the wire insulation, for example 30° to 60°. The material of drivers 14, in an example, is a tough grade of nylon, e.g. heat-stabilized Nylon 6. This has proved highly effective for making incisions into and through the insulation of vinyl-insulated wire without damaging solid or stranded copper wire. For this purpose, the material of driver 14 in an example may have a hardness of Rockwell Scale R110 to 118. Gap 28 is narrower than the space between the opposed cutting edges 47 as seen in FIG. 15**.

In use, a wire W is inserted in slot 40 above diverging edges 26 (FIG. 15) of terminal 20, as shown in FIGS. 1–3. Upward-diverging edges 26 of terminal 20 and downward-diverging areas 44 act initially to center the wire above gap 28, the narrowed top portions 14' permitting drivers 14 to deflect sideways, as needed to ensure centering. The wire is centered by the action of a couple which comprises the wire-engaging areas of the driver and of the prongs. These areas in pairs diverge downward and upward, respectively, in the illustrated example, yielding the benefit already noted of causing the wire to center each driver over the respective pairs of prongs.

Figure 19:
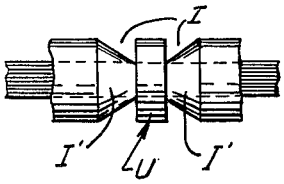
FIG. 19 is a view like FIG. 17A just before the wire is driven between prongs of a terminal.
Figure 16:
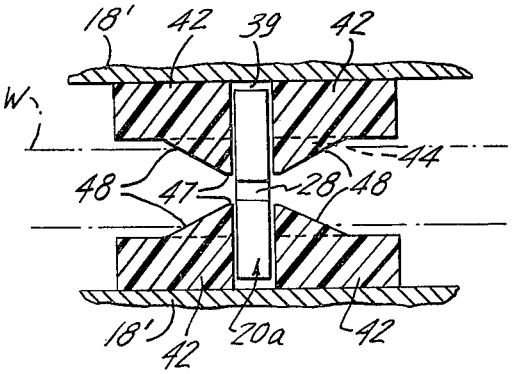
Figure 20:
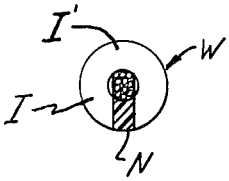
FIG. 20 is a cross-section of the wire at plane 18—18 after connection is completed.
Figure 17A:
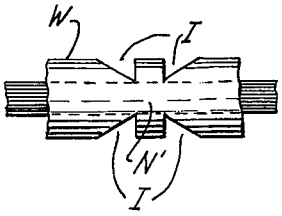
FIG. 17A is a fragmentary view of the insulated wire looking down on FIG. 17.
Figure 17:
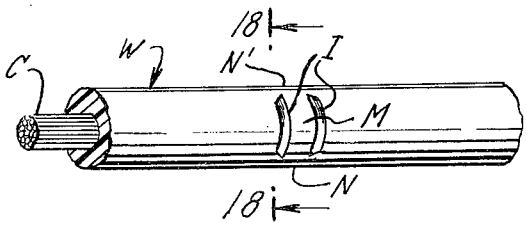
FIG. 17 is a greatly enlarged lateral perspective view of a wire after initial cuts in the insulation are made.
Figure 18:
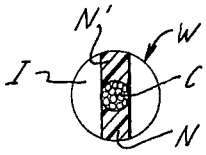
FIG. 18 is a crosss-section of the wire at plane 18—18 in FIG. 17.

As head 10 is driven downward farther, areas 44 are driven into the insulation. At this time, prongs 32 support the wire against the driver's thrust. In an example, strip 20 is resilient copper alloy 0.047×0.135 inch so that the ends of the prongs provide supporting areas for the wire against the thrust of the driver. Areas 44 start to make incisions in the wire insulation, these areas being defined by the surfaces of slot 39 and surfaces 48 extending at an angle to each other, and in addition slanting about 30° to the vertical. Areas 44 and edges 47 thus progressively form two pairs of incisions I (FIGS. 17 and 17A) in the wire insulation at opposite sides of the wire, each transverse pair being separated along the axis of the wire by a distance slightly greater than the thickness of portion 20*a* of terminal 20. These four incisions divide two bands M of insulation from the remainder of the wire insulation. Bands M are connected to the wire insulation at necks N and N' (FIGS. 17 and 18). After incisions I have been made, formations 46 and their adjacent chamfered surfaces drive downward and form incisions I' (FIG. 19), into or through the insulation on the top surface of the wire, thus forming an inverted "U"-shaped strip of insulation U (FIG. 19) attached to the rest of the wire insulation only at neck N. Further downward movement of head 10 forces conductor C toward gap 28 of terminal portion 20*a*, shearing the strip U from the neck N. The stiffness required of prongs 32 is, therefore, only that required to shear insulation at the neck N. Continuation of downward movement forces conductor C into the gap 28, both compressing the stranded wire and spreading the prongs 32 elastically. The end result is shown in FIG. 20. A U-shaped piece of insulation has been removed from the wire. Neck N of insulation has entered gap 28 of the terminal. Notably, three steps occur: (1) the driver first forms U-shaped incisions; (2) the driver forces the wire toward the terminal slot 28, causing the ends of the U-shaped strip of insulation to be ruptured so as to part the U-shaped strip completely from the rest of the insulation; and (3) the bared conductor is forced into the gap 28 between the prongs of the metal terminal.

It is understood that the sequence of cutting actions may vary, depending on the geometry of the cooperating parts and on their relative hardnesses. Thus, the parting of neck N' from the insulation along the wire, resulting from the action of the driver, might be less than complete before the wire is driven downward between the prongs. In that event, complete rupture of neck N' would take place while the wire is moving downward between the prongs of the terminal. Correspondingly, the slots I may penetrate incompletely through the insulation in some cases, making it easy for the prongs of the terminal to complete the removal of the wire insulation where the conductor is to be bared.

Conductor C often is of stranded copper. Chamfered or rounded transitions 50 are provided between diverging end surfaces 26 and the edges of slot 28, thereby avoiding damage to the conductor, as by tearing some of the strands of the conductor C. At the same time, prongs 32 are elastically spread a little in receiving the conductor C and thus grip conductor C resiliently. This resilience is controlled by the extended length of the cut 34 below gap 28 that divides the terminal prongs, and by the modulus of elasticity of the metal. The collective cross-section of the stranded conductor C is distorted by the grip of terminal portion 20*a*, but a secure connection is realized. Prongs 32 do not require any initial pre-bias. However, after the conductor is forced into gap 28, prongs 32 apply firm bias and make dependable contact to conductor C. Within limits, various wire sizes can be accommodated, and multiple wires having respective stranded conductors can be forced into gap 28 in successive driving operations of head 14.

Referring once again to FIGS. 1–3, drivers 14 extend into a space below guide portion 31 of the base member 18. In this region, the four legs 42 of the driver operate between and slide along walls 18' forming outside walls and inter-phase barriers providing external insulation for the terminals 20 and insulating terminals 20 from each other. Between walls 18' and below portion 31 of the base member, there are large openings 50 for each circuit, to admit a wire W and to facilitate assembly of terminals 20 into base member 18.

The illustrative embodiment of the invention described in detail above and shown in the accompanying drawings is readily modified by those skilled in the art without departing from the spirit of the invention and, accordingly, the invention should be broadly construed.

What is claimed is:

1. An electrical connector for wire having a conductor sheathed in insulation, including a head and a base, said base including a base member of insulation and at least one terminal formed of a metal strip divided along an end portion thereof into a pair of elongated resilient prongs having respective abutments and having opposite contact edges separated from each other by a gap extending from said abutments, said head and said base member having cooperating means for guiding the head in moving along said prongs between an elevated position and a depressed position, said head including at least one driver having a body and having four generally parallel legs supported at respective ends thereof on said body, the legs being defined by mutually crossing slots, a first one of which receives said prongs in the depressed position of the head and a second one of which receives the wire, an insulation-penetrating edge extending along each of said legs where the slots cross each other for making four incisions into the wire insulation including a pair of incisions at each side of the wire's conductor at transverse planes separated along the wire by approximately the thickness of the terminal, said wire being supported by the abutments of said prongs while said incisions are being made, said driver having means for forcing the wire's conductor into said gap and, incidental thereto, causing said terminal to strip insulation from the wire between pairs of said incisions.

2. An electrical connector as in claim 1, wherein said insulation-penetrating edges in each said plane are interconnected by a further edge portion on the body of the driver where the legs are supported for extending pairs of said incisions at opposite sides of the conductor so as to form a "U"-shaped piece of the wire insulation at least partially divided from the adjacent insulation of the wire.

3. The connector as in claim 1 wherein said driver is of insulation harder than vinyl insulation but softer than copper.

4. The connector as in claim 1 wherein said driver in its depressed position and the portion of said base member in cooperation therewith constitute a cover over the connection between said terminal and the wire.

5. The connector as in claim 1 wherein said abutments of the prongs diverge from the gap for centering a wire pressed against the prongs by the driver.

6. The connector as in claim 1 wherein said abutments diverge upward from the gap between the prongs and wherein said legs include respective portions that diverge downward from said second one of said slots for centering a wire opposite said gap, when the connector is oriented with the gap extending downward from said abutments.

7. The connector as in claim 1 wherein plural pairs of prongs as aforesaid are supported by the base member parallel to each other and wherein the head includes plural drivers, each driver having four legs cooperable with a respective pair of said prongs, all as aforesaid.

8. The connector as in claim 1 wherein said base has plural terminals as aforesaid whose said end portions are mutually spaced apart and extend parallel to each other, and wherein said head is formed of a unitary piece of insulation and includes plural drivers each formed as aforesaid and united for common movement along respective ones of said terminals, each of said driver and its related terminal having wire-camming means for centering a wire opposite the gap of its respective terminal.

9. An insulation-penetrating electrical connector for wire having a conductor sheathed in insulation, including a head and a base, said base including a base member of insulation and at least one metal terminal having a two-part abutment and a pair of opposed contact edges separated by a gap extending into the terminal from the parts of said abutment, respectively, said head having means for locating a length of the wire transversely opposite said gap and having means for making incisions in the wire insulation at opposite sides of the conductor, said two-part abutment being formed for largely preventing entry of the wire into the gap while said incisions are being made, and said head having means operative thereafter for forcibly displacing the wire transversely so that areas of the wire's conductor adjacent said incisions are bared by the terminal and gripped by said contact edges.

10. An electrical connector as in claim 9, wherein a transition is included between each of said contact edges and a corresponding one of the parts of said abutment for avoiding damage to the conductor of the wire when it is being forced into and along the gap.

11. The method of making a connection between a wire having a conductor sheathed in insulation and a metal terminal comprising a pair of prongs having contact edges separated by a gap, including the steps of making incisions in the wire insulation at opposite sides of the wire's conductor while the wire is supported against substantial displacement by abutment formations of the prongs, and then driving the wire laterally into said gap so that areas of the wire's conductor adjacent said incisions are bared and forced between said contact edges.

12. The method as in claim 11 wherein edges of material substantially harder than the wire's insulation but substantially softer than the wire's conductor are used in making said incisions.

13. The method as in claim 11 wherein said incisions include a pair of incisions at opposite sides of the wire's conductor in each of a pair of planes transverse of the wire at opposite sides of the pair of prongs.

14. The method as in claim 13 including the step of extending the incisions in each said plane at the side of the wire remote from the prongs into a continuous incision extending roughly three-fourths of the way around the wire to delineate a "U" shape.

15. The method as in claim 13 wherein said incisions are made with edges of polymeric material softer than copper.

16. The method of making a wire-stripping electrical terminal, including the steps of shearing an end portion of a metal strip lengthwise to divide the strip into prongs, the prongs being forced out of surface alignment with each other in this step, restoring the prongs into surface alignment with each other, the prongs then having adjacent sheared edges, and coining a localized depression into portions of said prongs at the adjacent sheared edges thereof spaced from the free ends of the prongs while confining the outer edges of at least portions of said prongs to limit separation thereof to the width of the strip plus a desired gap therebetween.

17. An electrical connector as in claim 9 wherein said head including said incision-making means thereof are of electrical insulation.

18. An electrical connector as in claim 9 wherein said terminal includes a portion having opposite sides in spaced-apart planes, each of said contact edges having intersections with each of said planes, said incision-making means including an incision-making edge aligned approximately with each of the four intersections of said opposed contact edges with said planes at opposite sides of said terminal, and wherein the terminal is proportioned to strip the insulation from opposite sides of the wire's conductor between incisions made by said incision-making means.

19. An electrical connector as in claim 9 wherein each said incision-making means has an incision-making edge, the included angle of which is about 30° to 60°.

20. An electrical connector for wire having vinyl insulation about a copper conductor as in any of claims 9, 17 or 19 wherein the material of said incision-making means is substantially harder than the vinyl insulation and substantially softer than the copper conductor of the wire.

21. An electrical connector as in any of claims 9, 17 or 19 wherein the material of said incision-making means is of electrical insulation having a hardness of about Rockwell Scale R110 to 118.

22. An insulation-penetrating electrical connector for plural wires each having a conductor sheathed in insulation, including a base and a head, said base having a base member of electrical insulation and plural metal terminals each of which comprises a pair of resilient insulation-stripping prongs separated by a wire-receiving gap, said metal terminals being insulated from each other and supported separately by said base member, said head being a unitary body of polymeric electrical insulation embodying cutting formations effective upon movement of the head along a path for making incisions adjacent each said metal terminal in the insulation of respective wires placed opposite said terminals and said head also embodying formations effective upon further movement of the head along said path for driving the wires into the gaps between said pairs of prongs, respectively, to cause said prongs to strip insulation adjacent said incisions from segments of the conductors of said wires and to cause said pairs of prongs to grip the thus bared conductor segments of said wires, while maintaining electrical insulation between the terminals.

23. A connector as in claim 8, wherein said drivers have flexible supporting means for accommodating lateral shifting thereof as may be necessary for alignment of each driver with its related terminal.

24. The method as in either of claims 13 and 14 wherein said incisions are made using formations having a hardness of about Rockwell Scale R110 to 118.

25. The method of making a wire-stripping electrical terminal as in claim 16, wherein said depression is spaced substantially from the opposite ends of the prongs.

26. The method of making a wire-stripping electrical terminal as in either of claims 16 or 25 wherein said shearing of the metal strip is extended to an undivided portion of the strip.

27. The method of making an electrical terminal including the steps of dividing a metal strip lengthwise to form a pair of elongated elements extending to an undivided portion of the strip from an end thereof by a shearing operation that causes said elements to be displaced out of surface alignment with each other, this shearing operation being characterized by stretching of the parent metal of the strip at the base of the division, and then forcing said elongated elements into surface alignment with each other, thereby creating a pair of elongated elements joined by the parent metal of the strip having opposed contact edges that curve divergently away from each other.

* * * * *